US005809666A

United States Patent [19]

Harwood

[11] Patent Number: 5,809,666

[45] **Date of Patent: *Sep. 22, 1998**

[54] MOLDED PLASTIC TOE CAP FOR SHOES

[76] Inventor: John M. Harwood, 15140 Irene Ct., Elm Grove, Wis. 53122

[ * ] Notice: The term of this patent shall not extend beyond the expiration date of Pat. No. 5,666,745.

[21] Appl. No.: 675,615

[22] Filed: Jul. 3, 1996

Related U.S. Application Data

[63] Continuation-in-part of Ser. No. 554,078, Nov. 6, 1995, Pat. No. 5,666,745.

[51] Int. Cl.[6] ..... A43C 13/14

[52] U.S. Cl. ..... 36/77 R; 36/72 R

[58] Field of Search ..... 36/72 R, 77 R, 36/77 M

[56] References Cited

U.S. PATENT DOCUMENTS

| | | | |
|---|---|---|---|
| 4,735,003 | 4/1988 | Dykeman | 36/77 R |
| 5,210,963 | 5/1993 | Harwood | 36/77 R |
| 5,331,751 | 7/1994 | Harwood | 36/77 R |
| 5,666,745 | 9/1997 | Harwood | 36/77 R |

FOREIGN PATENT DOCUMENTS

| | | | |
|---|---|---|---|
| 0100181 | 8/1984 | European Pat. Off. | 36/77 R |
| 4320312 | 1/1994 | Germany | 36/77 R |
| 2138272 | 10/1984 | United Kingdom | 36/77 R |
| 2071989 | 9/1991 | United Kingdom | 36/77 R |

*Primary Examiner*—M. D. Patterson
*Attorney, Agent, or Firm*—Andrus, Sceales, Starke & Sawall

[57] ABSTRACT

A protective plastic toe cap for shoes includes a construction incorporating three important minimum dimensions. These dimensions include side wall thickness, the radius of the transition between the walls and the bottom flange, and the bottom flange width. Careful selection of the plastic resin materials based on certain minimum physical properties is also disclosed.

6 Claims, 2 Drawing Sheets

FIG. 1
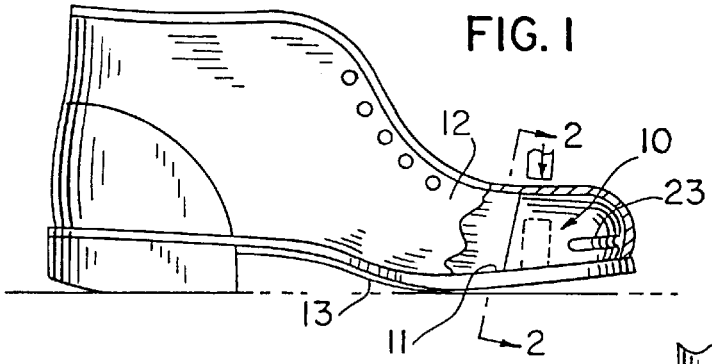
FIG. 2
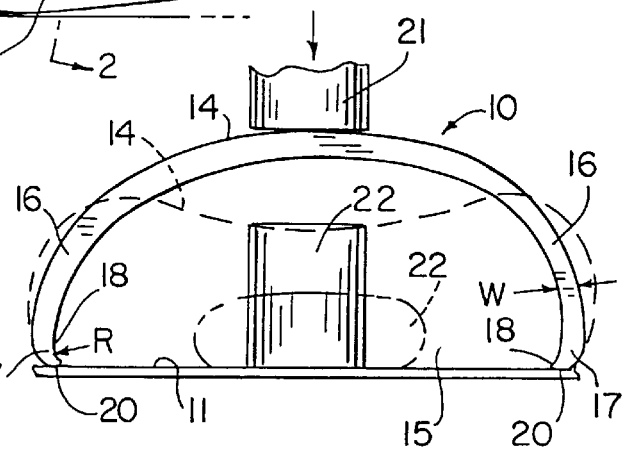
FIG. 3
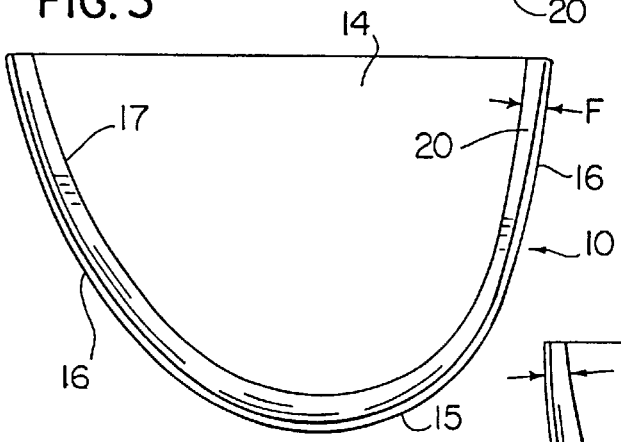
FIG. 5
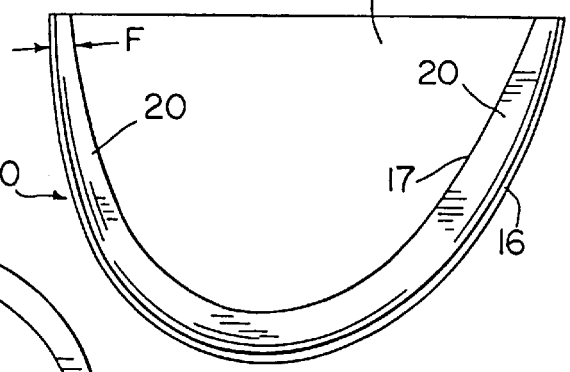
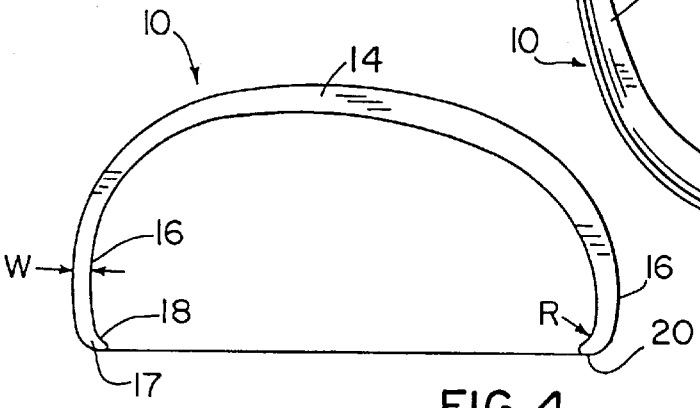
FIG. 4

MOLDED PLASTIC TOE CAP FOR SHOES

This is a continuation-in-part of application Ser. No. 08/554,078, filed Nov. 6, 1995, U.S. Pat. No. 5,666,745.

BACKGROUND OF THE INVENTION

The present invention relates to a toe cap for a protective shoe and, more particularly, to an injection molded plastic toe cap.

For many years, toe caps for protective shoes have been made of thin steel sheets formed into shoe toe-shaped bodies which are sewn or otherwise attached on the inside of the leather toe cap of a shoe or boot. Steel toe caps are known to deform under vertically applied compressive or impact loads and to undertake a permanent set which, if excessive, may result in a crushing and/or cutting injury to the toes of the wearer. Attempts have been made more recently to substitute various plastic materials for steel in safety toe caps and number of prior art patents show such constructions.

My prior U.S. Pat. Nos. 5,210,963 and 5,331,751 disclose injection molded plastic toe caps which utilize a fiber-filled plastic resin and are formed in a manner to optimally orient the reinforcing fibers to enhance the strength of the toe cap. These patents also disclose special structural shapes for strength optimization and controlled vertical collapse under load, as well as optimal molding parameters.

U.S. Pat. No. 4,735,003 discloses a molded plastic toe cap which may be made from a variety of thermoplastic and thermosetting resins, both with and without fiber reinforcement. Various molding techniques, including injection and compression molding are disclosed.

British Patent Application No. 2,138,272A also discloses a protective toe cap made from an injection molded glass-filled plastic material. European Patent Application No. 83304046.2 describes a protective toe cap for a shoe which is compression molded from a plastic material that is reinforced with uniaxially aligned continuous fibers extending laterally across the roof of the cap.

In the United States, suitability of toe caps for new protective footwear is determined in accordance with American National Standard for Personal - Protection Protective Footwear (ANSI Z41-1991). This Standard provides, inter alia, for separate compression and impact tests, both of which apply vertical loads to the roof of the toe cap actually installed in a shoe or boot. Similar but somewhat more rigorous standards are applicable in Canada under Canadian Standards Association toe impact test Z-195 March 1984. In Europe, the test regimen is dictated by DIN standards.

The rigorous test regimens to which protective toe caps are subject has it made extremely difficult to design and build a toe cap of either steel or plastic which will consistently meet any one of the standards, much less all of them. The problem is exacerbated by variations in toe cap styles in the United States and between the United States, Canada and Europe. These styles are, in turn, dictated to some extent by variations in the styles and in the construction of shoes, both work shoes and dress shoes which are modified to include protective toe caps. There is also a desire in the industry to eliminate steel toe caps for reasons in addition to those mentioned above, such as the heat and electrically conductive properties of steel. Also, the response of steel to magnetic fields or electrical signals makes it undesirable for certain military and the like applications.

Notwithstanding the improvements in plastic materials, molding techniques, and specific structural modifications, it has still proven to be a difficult engineering challenge to meet the rigorous standards for protective footwear as discussed above. Extensive testing of plastic toe caps molded to the shapes shown in the prior art patents discussed above suggests that subtle changes in dimensions and contours can have a significant effect on the ultimate strength of the toe cap and its ability to meet the compression and impact tests. On the other hand, it is desirable to minimize the plastic material used and therefore minimize the weight. It has also been found that there is a significant interrelationship between the protective plastic toe cap and the other materials from which the shoe is made, particularly the material for the inner sole. As a result, it would be desirable to have a molded plastic toe cap which, if constructed to certain minimum dimensions and using a variety of suitable plastic materials, would provide a toe cap strong enough to meet the safety test standards yet be small and light.

SUMMARY OF THE INVENTION

In accordance with the present invention, it has been determined that there are certain critical dimensions which, if minimum values are not met, are likely to result in failure of the toe cap to meet the test standards described herein. It has been found that the lateral opposite side walls must have a minimum thickness of 0.12 inch, the curved surface which defines the transition inside the toe cap between the walls and the bottom edge flange must have a minimum radius of curvature of 0.15 inch, and the lower edge flange must define a flat lower surface with the minimum width of 0.10 inch.

Suitable plastic materials, including certain plastics which are not reinforcing fiber-filled may be utilized and, if properly constructed, prior art features intended to provide a controlled collapse under load may also be eliminated. However, inclusion of features such as glass-filled plastics and special collapse control features result in enhanced performance of toe caps utilizing the minimum interrelated dimensions disclosed herein.

Plastic resin materials with certain physical strength properties have also been found to be important. Further, use of these materials requires consideration of the toe cap application which may be in conventional work shoes or in protective dress shoes. For work shoes, the sidewall thickness is not constrained by fashion and design considerations and, as a result, may be increased over the minimum set forth above. Thus, in a toe cap having a minimum sidewall thickness of 0.17 inch (4.3 mm), a plastic resin material having a flexural modulus as low as 200,000 psi may be used. Further, resins having that value of flexural modulus may be selected with a specific gravity of at least 0.9 $gm/cm^3$. A tensile modulus of material in excess of about 200,000 psi has also been found suitable.

If the sidewall thickness is reduced to satisfy the requirements of toe caps for use in protective dress shoes with a sidewall thickness of about 0.12 inch (3 mm), the flexural modulus of the plastic resin material must be increased to at least about 360,000 psi. A corresponding material specific gravity of at least 1.2 $gm/cm^3$ is desirable. The corresponding tensile modulus of material for the thinner wall section toe cap should be at leas about 330,000 psi.

BRIEF DESCRIPTION OF THE DRAWINGS

FIG. 1 is a side elevation, partly cut away, showing the installation of a toe cap of one embodiment of the present invention in a work shoe.

FIG. 2 is a rear elevation of a toe cap constructed in accordance with one embodiment of the invention and showing schematically its performance under standard testing.

FIG. 3 is a bottom plan of the toe cap shown in FIG. 2.

FIG. 4 is a rear elevation of another embodiment of the toe cap of the present invention.

FIG. 5 is a bottom plan view of the toe cap shown in FIG. 4.

DETAILED DESCRIPTION OF THE PREFERRED EMBODIMENTS

Figure 6:
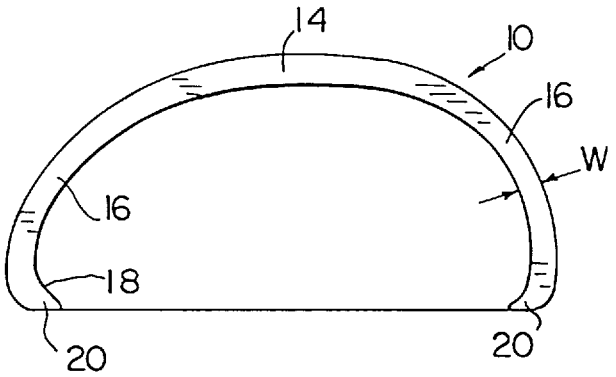
FIGS. 6 and 7 are views corresponding, respectively, to FIGS. 4 and 5, showing a further embodiment of the invention.
Figure 7:
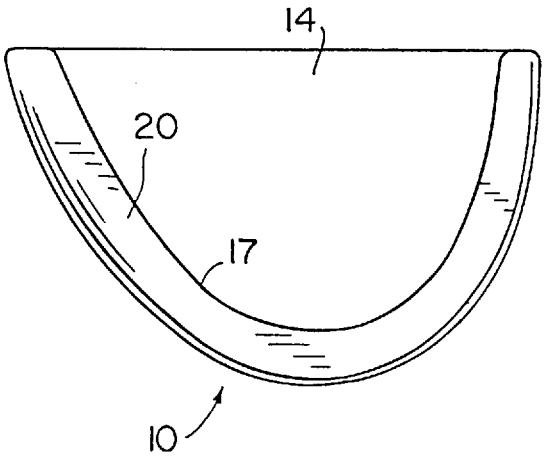
Figure 8:
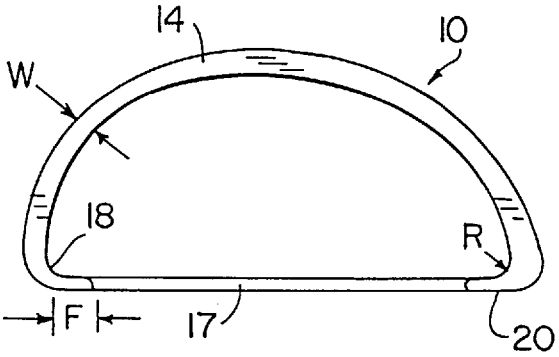
FIGS. 8 and 9 show, respectively, a rear elevation and a bottom plan view of yet another embodiment of the toe of the present invention.

In FIG. 1, there is shown a conventional work shoe having installed therein a toe cap 10 of the present invention. In accordance with conventional shoe industry practice, the toe cap 10 is installed during manufacture of the shoe by placing the same over an inner sole 11 and last and enclosing the toe cap in the shoe upper 12 which is subsequently attached to the shoe sole 13 in a conventional manner. Whether formed of sheet steel, molded of plastic, or made of some other material, toe caps all have a generally similar shape, although a number of different styles are utilized to accommodate varying shoe toe styles. Typically, the toe cap 10 is of generally the same shape as the upper toe portion of the shoe for which it is made.

Referring also to FIGS. 2 and 3, one embodiment of the toe cap 10 of the present invention comprises a unitary shoe toe-shaped body 9, including an upper roof 14 which slopes forwardly and laterally in a smooth continuous surface to blend into a front wall 15 and opposite lateral side walls 16. The toe cap body 13 is asymmetrical as is well known in the art. The front wall 15 and side walls 16 are generally vertical, however, they may be substantially curved over their entire extent, both vertically and horizontally, as shown. The side walls and front wall blend together to form a continuous outer wall and, in the embodiments shown, the continuous outer wall includes an integral inwardly turned bottom flange 17 along the entire lower edge of the body.

In accordance with the present invention, it has been found that, in addition to the use of suitable plastic resins, possibly with fiber reinforcement, as well as certain structural modifications, there are three specific toe cap dimensions which must be carefully controlled in order that the toe cap meet the required standards for strength. These dimensions are described hereinafter in terms of minimums which, of course, may be exceeded, but which must together be minimally attained. These dimensions include a thickness W of the side walls 16, a radius R of the curved surface which defines an interior transition 18 between the side walls 16 and the bottom flange 17, and a width F of the flat lower surface 20 which defines a narrow uniplanar base that rests on the inner sole 11 of the shoe. Specifically, it has been found that the foregoing minimum dimensions must be maintained as follows:

1. side wall thickness W=0.12 inch (3 mm);
2. transition radius R=0.15 inch (3.8 mm); and,
3. lower surface flange width F=0.10 inch (2.5 mm).

As shown in FIG. 2 and in accordance with the ANSI test standard identified above, a 50 pound (22.7 kg) load is attached to a flat one inch (25.4 mm) diameter nose 21 which is dropped onto the roof 14 from a height of approximately 18 inches (45.7 cm) or a height sufficient to provide an impact velocity of 118 inches per second (approximately 3 m/sec). The total downward deflection of the roof 14 of the toe cap under this impact load must maintain a minimum internal clearance between the inside of the roof 14 and the top of the inner sole 11 of 0.5 inch (about 13 mm). One manner of testing maximum deflection of the roof under load is to place a clay cylinder 22 inside the shoe under test and to measure its final height to which it is compressed after downward deflection of the toe cap, as shown in FIGS. 1 and 2.

It has been found that the material from which the shoe inner sole 11 is made may have a significant effect upon the ability of the shoe and installed toe cap to pass the impact and corresponding compression load tests. Shoe manufacturers may utilize inner sole materials of significantly varying hardness, ranging from hard leather materials having a hardness of about 140 durometer to a soft polyurethane having a hardness of about 60 durometer. The significance of this variation is that, under vertical load, the bottom flange 17 of the toe cap will have a tendency to penetrate and sink into softer inner sole materials. Conversely, harder leather inner sole materials are not as susceptible to bottom flange penetration under load. Also, because the typical toe cap 10, as shown in each of the embodiments herein, has side walls 16 which curve inwardly to form the bottom flange 17 along the transition 18, there is a tendency under load for the flanges to be forced inwardly. As a result, the softer inner sole materials have a tendency to wrinkle and rise inside the shoe. Such wrinkling may significantly reduce the effective minimum vertical clearance within the shoe and make it more difficult to meet the 0.5 inch minimum internal clearance required to meet the test standard.

The toe cap shown in FIGS. 2 and 3 has a bottom flange 17 which includes a flat lower surface 20 having a relatively narrow width F. This toe cap is particularly well suited to be used in shoes with harder materials for the inner sole 11, such as hard leather. As the softness of the inner sole material increases, to for example 60 durometer of a soft polyurethane, the width of the lower surface 20 may be correspondingly increased to assure better resistance to bottom flange penetration into the inner sole material. The increase in width F of the lower flat surface 20 may be seen by the progressively wider dimensions F shown in FIGS. 3, 5, 7 and 9.

As may be seen by a comparison of FIGS. 2, 4, 6 and 8, the side wall thickness W does not vary significantly from one toe cap shape to another. This is because the thickness of the side walls 16 is a primary factor in toe cap strength and the ability of the toe cap to meet the indicated test standards. Referring particularly to FIG. 2, the downward deflection of the roof 14 of the toe cap and the consequent outward bulging or deflection of the side walls 16 is shown in dashed lines. If the thickness W of the side walls is not maintained at a thickness of at least 0.12 inch (3 mm), the use of otherwise suitable plastics in the manufacture may result in a significant outward bulging (beyond that shown schematically in FIG. 2), resulting in toe cap failure. There is a particular concern in the footwear industry that an initial impact which is below either of the impact or compression loads dictated by the applicable test standard will cause a weakening in the material short of actual failure. However, the weakened toe cap may no longer have the strength to resist another impact or compression load, even within the limits of the test regimen. Toe caps with less than the minimum side wall thickness tend to flex outwardly far beyond the dashed line shown in FIG. 2 or to collapse completely, resulting in test failure in either case. Toe caps of the present invention, when made with proper plastic materials, have shown an ability to resist without failure multiple test loads under either of the applicable impact or compression load tests.

The significance of the minimum value for the radius of curvature R in the zone of transition 18 between the side walls 16 and the bottom flange 17 is the avoidance of sharp breaks which lead to stress concentrations under load. The minimum radius of curvature for the transition 18 assures that stress concentrations in this region are minimized.

Although a glass-filled polyurethane plastic of the type described in my prior patents, identified above, is one of the better performing materials for toe caps of the present invention, other plastic resins may also be utilized, including resins which do not have fiber reinforcement. Other suitable plastic materials include polyolefins and nylons. A particularly suitable nylon is an impact-modified type, such as an AMODEL ET 1000 Series sold by Amoco. Also, the toe cap of the present invention may include a region of substantially reduced cross section in the front wall 15, such as provided by an elongate generally horizontal notch 23. The notch extends along the entire front wall 15 and rearwardly along and into portions of both side walls 16, as described in detail in my above identified U.S. Pat. No. 5,210,963.

Figure 10:
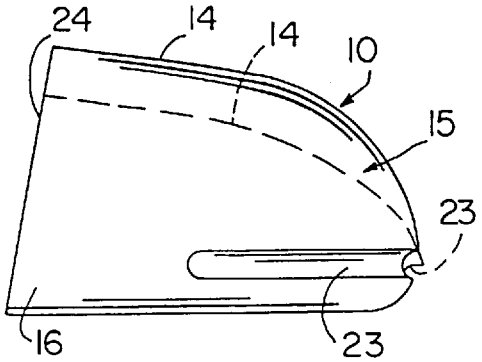
FIG. 10 is a side elevation view of the toe cap shown in FIG. 2.
Figure 9:
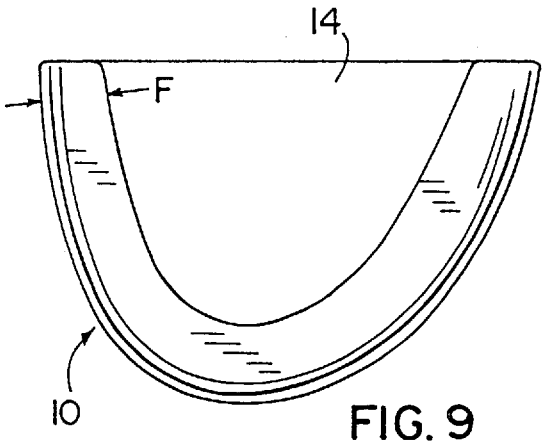

Referring to FIG. 10, the dashed line shows generally the manner in which the horizontal notch 23 in the front wall of the toe cap assists in helping to absorb a vertical impact or compression load imposed on the roof 14, in the manner generally shown in FIG. 2. The reduced cross section in the front wall which extends into both side walls 16 as well provides a controlled collapse under load. The notch 23 may actually close under load, as shown schematically, but due to the strength and resilience of the material, will return to its original position when the load is removed. As shown in the prior art, the rear edge 24 of the toe cap may be provided with a forwardly sloping face.

As indicated above, proper selection of the plastic resin material is important in providing toe caps of the minimum required dimensions which will pass the required test. In this regard, certain characteristics of the plastic resins tested have been found to be significant in providing toe caps of the required strength. The minimum toe cap dimensions discussed hereinabove are intended for a protective toe cap which can be utilized in the manufacture of men's dress shoes. It is, of course, a common occurrence for supervisory, management and other personnel who do not typically wear work shoes on the job to visit plant or construction sites where protective footwear is advisable, necessary, or required. For toe protected dress shoes, the shoe manufacturers require toe caps with the minimum indicated dimensions in order to adapt them to dress shoe styles.

On the other hand, work shoes are typically bulkier, roomier and therefor, may utilize heavier toe caps without compromising the shoe style or manufacturing process. Thus, for protective work shoes, dimensionally heavier toe caps may utilize plastic resin materials which would be unsuitable for the thinner toe caps used in protective dress shoes.

Among the important physical properties which plastic resin materials used in protective toe caps must minimally meet are flexural modulus, tensile modulus and specific gravity. Plastic resin materials with certain minimum physical strength properties and minimum specific gravities have been found to be suitable for the two types of toe caps used in work shoes and dress shoes. Various plastic resin materials were selected and tested to determine the strength and specific gravity levels necessary for toe caps in order to meet the requirements of the ANSI test for protective footwear, described above. Two different toe caps were molded, one having a sidewall thickness W of 0.17 inch (4.3 mm), to simulate a toe cap thickness suitable for work shoes, and the other having a sidewall thickness W of 0.112 inch (2.8 mm) to simulate a toe cap suitable for use in dress shoes. The toe caps were otherwise similarly shaped, as described above. Six plastic resin materials were selected and toe caps of both sizes were injection molded from each of the six resins. Ten toe caps of each size and made with each of the six resins were selected at random for testing in accordance with ANSI Z41 (1991) standard drop test identified above.

Table 1 lists the six selected plastic resin materials, identifies each by test number and lists the flexural modulus, tensile modulus and specific gravity for each.

TABLE 1

| MATERIAL NO. | MATERIAL | FLEXURAL MODULUS | TENSILE MODULUS | SPECIFIC GRAVITY |
|---|---|---|---|---|
| 1 | XEUG-50 | 1,700,000 | 2,140,000 | 1.63 |
| 2 | PUG-60 | 2,300,000 | 2,460,000 | 1.76 |
| 3 | AMODEL (TM) AT-1125 | 1,100,000 | 1,140,000 | 1.35 |
| 4 | ESTALOC (TM) 59660 | 652,000 | 797,000 | 1.45 |
| 5 | POLYCARBONATE | 360,000 | 330,000 | 1.21 |
| 6 | POLYPROPYLENE | 205,000 | 205,000 | .900 |

1,2 Glass-filled urethane manufactured by Celenese Corp.
3 Impact modified nylon manufactured by Amoco Corp.
4 Urethane manufactured by B F Goodrich Co.

The ten sample toe caps of each resin material were subjected to the indicted drop test with each toe cap tested being subjected to five successive drops. The results of the drops on each of the 10 toe cap samples for the heavier work shoe cap were averaged and are listed in Table 2.

TABLE 2

Side Wall Thickness .170 in. (4.3 mm)
AVERAGE REMAINING HEIGHT

| | MATERIAL NO. | | | | | |
|---|---|---|---|---|---|---|
| Drop # | 1 | 2 | 3 | 4 | 5 | 6 |
| 1 | 1.08 | .890 | .744 | .680 | .584 | .505 |
| 2 | .872 | .833 | .655 | .598 | .259 | .000 |
| 3 | .772 | .729 | .548 | .277 | .000 | .000 |
| 4 | .758 | .722 | .497 | .000 | .000 | .000 |
| 5 | .699 | .620 | .250 | .000 | .000 | .000 |

The results are the measured height of the clay test cylinder placed inside the toe cap on the test surface and in line with the dropped load, all as described in greater detail hereinabove. The ANSI drop test requires that the toe cap pass only the initial drop, leaving a minimum internal clearance (height of clay cylinder) of 0.5 inch (about 13 mm). It has been found, however, that the heavier wall work shoe toe caps, with certain plastic resin materials, were able to successfully withstand all five successive drops without failure, as shown in Table 2.

Table 3 is similar to Table 2 and shows the results of the tests of the six plastic resin materials on the thinner sidewall toe cap intended for use in dress shoes. Significantly, all materials, except material number 6, passed the initial drop test. In addition, the toe caps made with material numbers 1 and 2 successfully passed the following drop number 2.

TABLE 3

| Side Wall Thickness .112 in. (2.84 mm) AVERAGE REMAINING HEIGHT | | | | | | |
|---|---|---|---|---|---|---|
| | MATERIAL NO. | | | | | |
| Drop # | 1 | 2 | 3 | 4 | 5 | 6 |
| 1 | .786 | .790 | .590 | .605 | .501 | .280 |
| 2 | .585 | .610 | .430 | .385 | .000 | .000 |
| 3 | .229 | .000 | .315 | .229 | .000 | .000 |
| 4 | .000 | .000 | .000 | .000 | .000 | .000 |
| 5 | .000 | .000 | .000 | .000 | .000 | .000 |

I claim:

1. An injection molded plastic resin toe cap for a protective shoe, said toe cap of the type having a rearwardly opening shoe toe-shaped body including a roof which blends smoothly into laterally opposite generally vertical side walls and a generally vertical front wall, an open rear end defined by a rear edge including the rear edges of the roof and side walls, and an open bottom defined by a continuous bottom flange forming the lower edges of the side walls and front wall, said toe cap comprising:

the side walls having a minimum thickness of 0.17 inch (4.3 mm);

a continuous curved surface defining an interior transition between the walls and the flange, said surface having a minimum radius of curvature of about 0.15 inch;

the bottom flange having a continuous flat lower surface defining a uniplanar base; and, said molded plastic resin having a flexural modulus in the range of about 200,000 psi to about 1,700,000 psi.

2. The toe cap as set forth in claim 1 wherein the plastic resin has a specific gravity of at least 0.9 gm/cm.

3. The toe cap as set forth in claim 1 wherein the plastic resin has a tensile modulus in the range of about 200,000 psi to about 2,100,000 psi.

4. An injection molded plastic resin toe cap for a protective shoe, said toe cap of the type having a rearwardly opening shoe toe-shaped body including a roof which blends smoothly into laterally opposite generally vertical side walls and a generally vertical front wall, an open rear end defined by a rear edge including the rear edges of the roof and side walls, and an open bottom defined by a continuous bottom flange forming the lower edges of the side walls and front wall, said toe cap comprising:

the side walls having a minimum thickness of 0.12 inch (3 mm);

a continuous curved surface defining an interior transition between the walls and the flange, said surface having a minimum radius of curvature of about 0.15 inch;

the bottom flange having a continuous flat lower surface defining a narrow uniplanar base; and, said molded plastic resin having a flexural modulus in the range of about 360,000 psi to about 1,700,000 psi.

5. The toe cap as set forth in claim 4 wherein the plastic resin has a tensile modulus in the range of about 330,000 psi to about 2,100,000 psi.

6. The toe cap as set forth in claim 5 wherein the plastic resin has a specific gravity of at least 1.2 gm/cm$^3$.

* * * * *

UNITED STATES PATENT AND TRADEMARK OFFICE

CERTIFICATE OF CORRECTION

PATENT NO. : 5,809,666

DATED : Sept. 22, 1998

INVENTOR(S) : JOHN M. HARWOOD

It is certified that error appears in the above-indentified patent and that said Letters Patent is hereby corrected as shown below:

Claim 2, Col. 8, Line 2 delete "gm/cm" and substitute therefor --gm/cm$^3$--

Signed and Sealed this

Sixteenth Day of February, 1999

*Attest:*

*Attesting Officer*

*Acting Commissioner of Patents and Trademarks*